US008176945B2

(12) United States Patent
Westerkamp et al.

(10) Patent No.: US 8,176,945 B2
(45) Date of Patent: May 15, 2012

(54) PAPER MACHINE CLOTHING

(75) Inventors: Arved Westerkamp, Dettingen (DE); Johann Boeck, Neufelden (AT)

(73) Assignee: Voith Fabrics Patent GmbH, Heidenheim (DE)

( * ) Notice: Subject to any disclaimer, the term of this patent is extended or adjusted under 35 U.S.C. 154(b) by 1028 days.

(21) Appl. No.: 11/185,702

(22) Filed: Jul. 21, 2005

(65) Prior Publication Data

US 2006/0016508 A1 Jan. 26, 2006

(30) Foreign Application Priority Data

Jul. 22, 2004 (DE) ..... 10 2004 035 523

(51) Int. Cl.
*D03D 3/04* (2006.01)
*D21F 7/08* (2006.01)
*D03D 25/00* (2006.01)

(52) U.S. Cl. ..... 139/383 A; 139/383 AA; 139/383 R; 162/358.2

(58) Field of Classification Search ..... 139/383 A, 139/383 AA
See application file for complete search history.

(56) References Cited

U.S. PATENT DOCUMENTS

| | | | | | |
|---|---|---|---|---|---|
| 4,815,499 | A * | 3/1989 | Johnson | ..... | 139/383 A |
| 4,998,568 | A * | 3/1991 | Vohringer | ..... | 139/383 A |
| 5,465,764 | A * | 11/1995 | Eschmann et al. | ..... | 139/383 A |
| 5,544,678 | A * | 8/1996 | Barrett | ..... | 139/383 A |
| 5,613,527 | A * | 3/1997 | Zimmermann et al. | .. | 139/383 A |
| 5,826,627 | A * | 10/1998 | Seabrook et al. | ..... | 139/383 A |
| 6,123,116 | A * | 9/2000 | Ward et al. | ..... | 139/383 A |
| 6,202,705 | B1 * | 3/2001 | Johnson et al. | ..... | 139/383 A |
| 6,223,780 | B1 * | 5/2001 | Kaldenhoff | ..... | 139/383 A |
| 6,240,973 | B1 * | 6/2001 | Stone et al. | ..... | 139/383 A |
| 6,244,306 | B1 * | 6/2001 | Troughton | ..... | 139/383 A |
| 6,276,402 | B1 | 8/2001 | Herring | | |
| 6,334,467 | B1 * | 1/2002 | Barrett et al. | ..... | 139/383 A |
| 6,354,335 | B1 * | 3/2002 | Taipale et al. | ..... | 139/383 A |

* cited by examiner

*Primary Examiner* — Bobby Muromoto, Jr.
(74) *Attorney, Agent, or Firm* — Greenblum & Bernstein, P.L.C.

(57) ABSTRACT

Paper machine clothing that includes interwoven warp threads and weft threads forming a weaving pattern composed of repeat units having at least 26 warp threads. The weaving pattern, one of on its own or in combination, is formed by at least one of: at least one basic textile weave, at least one derivative of a basic textile weave, and at least one extension of a basic textile weave.

29 Claims, No Drawings

PAPER MACHINE CLOTHING

CROSS-REFERENCE TO RELATED APPLICATIONS

The present application claims priority under 35 U.S.C. §119 of German Patent Application No. 10 2004 035 523.1 filed Jul. 22, 2004, the disclosure of which is expressly incorporated by reference herein in its entirety.

BACKGROUND OF THE INVENTION

1. Field of the Invention

The invention relates to paper machine clothing, in particular for use in the forming section of a machine for producing paper, board or tissue.

2. Discussion of Background Information

In paper machine clothing, in particular for use in the forming section, the suitability for practically different intended uses is defined by the properties comprising wearing volume (increase in the running time), tendency to marking, printability, stability and thickness. In the case of woven paper machine clothing, these properties are defined by the selection of the weaves used.

In particular because of increased customer requirements with respect to paper quality and the trend to faster and faster and wider paper machines, for paper machine clothing of the coming generation there is increasingly a requirement to be able to adapt this flexibly to the respective intended use.

SUMMARY OF THE INVENTION

According to invention, paper machine clothing is provided having warp threads and having weft threads which are interwoven, forming a weaving pattern. It is possible for the weaving pattern to be described by lining up extremely small repeat units, and the weaving pattern per repeat unit has at least 26 warp threads. Further, on its own or in combination, the weaving pattern is formed by: at least one basic textile weave and/or at least one derivative of a basic textile weave and/or at least one extension of a basic textile weave.

The previous limitations which existed because of the lacking number of warp threads and which were compensated for by "compromise-laden" weaves can now be removed by an application-specific combination of basic weaves and extensions/derivatives of basic weaves. In this case, the high number of warp threads (≧26 shafts; for the further discussion the terms number of shafts and number of warp threads will be used in an equivalent manner) permits a virtually free combination of the weaves with one another.

In this case, both in a repeat unit, basic weaves and extensions/derivatives of the same basic weave can be combined with one another, that is to say, for example, a 30-shaft warp repeat with 15-shaft satin weave combined with a 15-shaft double satin weave.

However, mixed forms are also conceivable. For example, a 30-shaft warp repeat is formed by a combination of a 10-shaft satin weave, a 10-shaft weft-side broad satin wale twill weave and a 10-shaft cross-twill weave.

The present invention is directed to paper machine clothing that includes interwoven warp threads and weft threads forming a weaving pattern composed of repeat units having at least 26 warp threads. The weaving pattern, one of on its own or in combination, is formed by at least one of: at least one basic textile weave, at least one derivative of a basic textile weave, and at least one extension of a basic textile weave.

In accordance with a feature of the invention, the weaving pattern is formed by lining up the repeat units. Moreover, the repeat units are extremely small.

According to another feature of the instant invention, the weaving pattern in the repeat unit may be formed by at least 28 warp threads. Further, the weaving pattern in the repeat unit can be formed by at least 30 warp threads, by at least 40 warp threads, or by at least 50 warp threads.

In accordance with still another feature of the present invention, the basic textile weaves can include one of a plain weave, a twill weave, or a satin weave.

The weaving pattern may be formed by one warp layer and at least one weft layer. Further, the at least one weft layer may include two weft layers.

The weaving pattern may be formed by two warp layers and at least one weft layer. Moreover, the at least one weft layer can include two weft layers.

Moreover, the weaving pattern can be formed by three warp layers and two weft layers.

According to a further feature, the weaving pattern may be formed by weaving a paper-side warp layer with a paper-side weft layer and by weaving a machine-side warp layer with a machine-side weft layer and by weaving binding threads running in the warp or weft direction with paper-side weft or warp threads, forming covering binding points, and with machine-side weft or warp threads, forming supporting binding points. The weaving pattern can be formed by weaving paper-side warp and weft threads is continued by weaving the binding threads with the paper-side warp or weft threads.

Further, the weaving pattern formed by weaving the paper-side warp and weft threads is formed on its own or in combination by at least one of: at least one basic textile weave, at least one derivative of a basic textile weave, and at least one extension of a basic textile weave.

Still further, the weaving pattern formed by weaving the machine-side warp and weft threads is formed on its own or in combination by at least one of: at least one basic textile weave, at least one derivative of a basic textile weave, and at least one extension of a basic textile weave.

Moreover, the weaving pattern formed by weaving the binding threads with the paper-side warp or weft threads is formed on its own or in combination by: at least one basic textile weave and/or at least one derivative of a basic textile weave and/or at least one extension of a basic textile weave.

Further still, the weaving pattern formed by weaving the binding threads with the machine-side warp or weft threads is formed on its own or in combination by at least one of: at least one basic textile weave, at least one derivative of a basic textile weave, and at least one extension of a basic textile weave.

In accordance with a feature of the invention, the paper machine clothing can be formed as one of a forming fabric, a dryer fabric, or a base fabric for a press felt. The forming fabric can have a thickness of less than 0.75 mm. Further, the forming fabric may have a thickness of less than 0.7 mm, and a width of greater than 8 meters. Still further, the forming fabric can be structured to be driven with a machine speed greater than 1200 m/min, and preferably, driven with a machine speed greater than 1500 m/min.

In accordance with still yet another feature of the present invention, the forming fabric can be used for the production of graphic paper.

DETAILED DESCRIPTION OF THE PRESENT INVENTION

To explain the advantage of the virtually free possible combinations of weaves, the following example is to be used:

In a repeat unit, the percentage ratio of minimum warp raising points to the number of possible weaving points over a shaft number interval of at least 2 to at most 56 shafts is between 100% and 2%. The percentage ratio of the minimum possible warp raising points to the number of maximum warp raising points within one repeat unit likewise lies in this interval.

If the differential value between the minimum number of warp raising points to the maximum number of warp raising points and the minimum number of warp raising points to the number of possible weaving points is formed, then the result is that, beginning at a differential value of less than 0.15%, an optimum ratio results in relation to the distribution of the individual points and thus the possible tendency to marking of the fabric in the paper.

The aforementioned differential value is achieved by a weaving pattern which has at least 26 warp threads per repeat unit.

An extension of a basic textile weave is produced in that in each case individual warp raising points or else a plurality of warp raising points is added to the already existing weaving points of a weft weave. This attachment can be carried out in the longitudinal or transverse direction, upward, downward, to the right or to the left. The same weaves arise if points are taken away from a basic weave on the warp side. This change in the weave is also designated reinforcement, but in this case this procedure must not be confused with the addition of other thread systems. The plain weave cannot be extended. Examples of extensions, based on the twill weave as basic weave, are a weft-side broad wale twill K2/4Z or a warp-side broad wale twill K4/2Z.

A basic textile weave can likewise be varied via derivatives. There is, for example, the possibility of changing the offset, the duplication of individual threads or groups of threads, mirroring or the displacement of individual binding passages.

Normally, the repeat is enlarged in this way; there are then a plurality of equally binding threads in the warp repeat, which accordingly have to be accommodated on the same shaft as well. This produces patterned shaft drafts. Examples of derivatives based on the plain weave as basic weave are a smooth rib weave RQ2/2 or a mixed rib weave RQ3/2/1/3/2/1.

In order to increase the possible variation further and thus to permit the possibility of the virtually free combination of weaves in accordance with the requirements of the customer, a particularly preferred embodiment of the invention provides for the weaving pattern per repeat unit to be formed by at least 28 or 30 or 40 or 50 or more warp threads.

The basic textile weaves are a plain weave or a twill weave or a satin weave.

From the aforementioned basic weaves and corresponding extensions or derivatives (of which only some are shown by way of example in order to explain the principles), weaves can now be combined in accordance with the requirements of the customer.

In this case it is possible both for the weaving pattern to be formed by one warp layer and one weft layer or by one warp layer and two weft layers.

Furthermore, it is possible for the weaving pattern to be formed by two warp layers and one weft layer or by two warp layers and two weft layers.

Moreover, it is possible for the weaving pattern to be formed by three warp layers and two weft layers.

Since different requirements are placed on the paper side of paper machine clothing in relation to the machine side, for example in the case of a forming fabric the fibrous web is formed on the paper side, whereas in particular high requirements are placed on the wear resistance on the machine side.

A preferred embodiment of the invention therefore provides for the weaving pattern to be formed by weaving a paper-side warp layer with a paper-side weft layer and by weaving a machine-side warp layer with a machine-side weft layer and by weaving binding threads running in the warp or weft direction with paper-side weft or warp threads, forming covering binding points, and with machine-side weft or warp threads, forming supporting binding points. Such paper machine fabrics are designated two-layer fabrics.

In particular in order to improve the tendency to marking, the binding threads, depending on whether these run in the warp or weft direction, are woven with the paper-side weft or warp threads in such a way that the pattern formed by weaving paper-side warp and weft threads is continued by these. Such fabrics are designated SSB fabrics.

In particular, supporting binding points in the case of SSB fabrics make a substantial contribution to the tendency to marking. In this case, markings become visible in particular when these are arranged in a regular structure. Because of the high number of warp threads and the associated virtually free possibility of weaves, a virtually free and irregular arrangement of the covering and supporting binding points is also possible, which means that the tendency to marking can be reduced considerably.

In the case of two-layer paper machine clothing, that is to say, for example, with two warp layers and two weft layers, with binding threads and a paper-side weaving pattern and a machine-side weaving pattern, the following possibilities for the construction are conceivable:

- the paper-side weaving pattern formed by weaving the paper-side warp and weft threads is formed on its own or in combination by: at least one basic textile weave and/or at least one derivative of a basic textile weave and/or at least one extension of a basic textile weave,
- the machine-side weaving pattern formed by weaving the machine-side warp and weft threads is formed on its own or in combination by: at least one basic textile weave and/or at least one derivative of a basic textile weave and/or at least one extension of a basic textile weave,
- the pattern of the covering binding points formed by weaving the binding threads with the paper-side warp or weft threads is formed on its own or in combination by: at least one basic textile weave and/or at least one derivative of a basic textile weave and/or at least one extension of a basic textile weave,
- the pattern of the supporting binding points formed by weaving the binding threads with the machine-side warp or weft threads is formed on its own or in combination by: at least one basic textile weave and/or at least one derivative of a basic textile weave and/or at least one extension of a basic textile weave.

The paper machine clothing according to the invention is preferably a forming fabric or a dryer fabric or a base fabric for a press felt or for a transport belt or for a smoothing belt.

In particular for use in high-speed paper machines (machine speeds greater than 1200 m/min), the forming fabric has a thickness of less than 0.75 mm, preferably of less than 0.7 mm.

The forming fabric according to the invention is suitable in particular for use in paper machines with a great width. In particular in the case of wide paper webs, a tendency to marking of the forming fabric is highly visible, since the marking often continues over the entire width of the paper web. As a result of the virtually free possibility of combining weaves and the possibility of the virtually free and irregular arrangement of the supporting and covering binding points, it is possible to design the forming fabric according to the invention preferably with a width of more than 8 meters. Accordingly, a preferred embodiment of the invention provides for the forming fabric to have a width of greater than 8 meters.

Moreover, provision is made for the forming fabric to be used for intended purposes with a machine speed of more than 1200 m/min, preferably of more than 1500 m/min. The fabric according to the invention has a positive effect on the tendency to marking in particular at high speeds, since the dewatering times become shorter and therefore so do the dewatering pressures necessary for the dewatering. For this reason, it is advantageous to achieve the most "inhomogeneous" uniformity possible (this is to be seen to include, for example, an irregular distribution, that is to say not following any regular pattern, of the covering or supporting binding points, which have no concentration points) in the weave, in order to reduce the marking.

The forming fabric according to the invention is preferably used for the production of graphic paper. This follows from the fact that, in particular in the case of graphic papers, markings have a detrimental effect on the appearance of the paper and its printability and, in the case of a forming fabric according to the invention, the tendency to marking is reduced sharply, for example because of its virtually free and irregular distribution of its supporting binding points.

The invention is to be explained below by using two matrices, which show preferred embodiments of weaves for forming fabrics having two warp and two weft layers and having binding threads. Matrices 1 and 2 show the possibility of using basic weave, derivative, extensions or a combination of the same.

Matrix 1:

| $v_n$ | Basic weave | Extension | Derivative | Combination of extension/ derivative |
|---|---|---|---|---|
| Type of weave on paper side | X | | | |
| Type of weave on machine side | X | | | |
| Binding weft supporting binding point | | | | X |

According to matrix 1, the paper-side weave structure is formed by a basic weave, for example by a plain weave. Moreover, the machine-side weave structure is likewise formed by a basic weave, for example by an atlas weave. In order to achieve a virtually irregular distribution of the supporting binding points, the weaving pattern of the supporting binding points is formed by a combination of basic weave, its extension and its derivative.

Matrix 2:

| $v_n$ | Basic weave | Extension | Derivative | Combination of extension/ derivative |
|---|---|---|---|---|
| Type of weave on paper side | X | | | |
| Type of weave on machine side | | X | | |
| Binding weft supporting binding point | | | | X |

According to matrix 2, the paper-side weaving structure is formed by a basic wave, for example by a plain weave. Moreover, the machine-side weaving structure is formed by the extension of a basic weave, for example by an 8-bond weft-side double satin weave. In order to achieve a virtually irregular distribution of the supporting binding points, the weaving pattern of the supporting binding points is formed by a combination of basic weave, its extension and its derivative, such as by a 5-shaft satin weave with pitch 2, a 5-shaft satin weave with pitch 3 and a modified 5-shaft cross-twill.

It goes without saying that the invention is not restricted to the embodiments shown but can be modified and supplemented in many ways by those skilled in the art.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A paper machine clothing comprising:

a forming fabric comprising interwoven warp threads and weft threads forming a weaving pattern composed of repeat units having at least 26 warp threads;

wherein the forming fabric has a thickness of less than 0.75 mm, the forming fabric is structured and arranged to be driven with a machine speed greater than 1200 m/min, and said weaving pattern being formed by at least one extension of a basic textile weave.

2. The paper machine clothing in accordance with claim 1, wherein weaving pattern is formed by lining up said repeat units.

3. The paper machine clothing in accordance with claim 2, wherein said repeat units are extremely small.

4. The paper machine clothing as claimed in claim 1, wherein said weaving pattern in said repeat unit is formed by at least 28 warp threads.

5. The paper machine clothing as claimed in claim 1, wherein said weaving pattern in said repeat unit is formed by at least 30 warp threads.

6. The paper machine clothing as claimed in claim 1, wherein said weaving pattern in said repeat unit is formed by at least 40 warp threads.

7. The paper machine clothing as claimed in claim 1, wherein said weaving pattern in said repeat unit is formed by at least 50 warp threads.

8. The paper machine clothing as claimed in claim 1, wherein said basic textile weaves comprise one of a plain weave, a twill weave, or a satin weave.

9. The paper machine clothing as claimed in claim 1, wherein said weaving pattern is formed by one warp layer and at least one weft layer.

10. The paper machine clothing in accordance with claim 9, wherein the at least one weft layer comprises two weft layers.

11. The paper machine clothing in accordance with claim 1, wherein the weaving pattern is formed by two warp layers and at least one weft layer.

12. The paper machine clothing in accordance with claim 11, wherein the at least one weft layer comprises two weft layers.

13. The paper machine clothing in accordance with claim 1, wherein said weaving pattern is formed by three warp layers and two weft layers.

14. The paper machine clothing in accordance with claim 1, wherein said weaving pattern is formed by weaving a paper-side warp layer with a paper-side weft layer and by weaving a machine-side warp layer with a machine-side weft layer and by weaving binding threads running in the warp or weft direction with paper-side weft or warp threads, forming covering binding points, and with machine-side weft or warp threads, forming supporting binding points.

15. The paper machine clothing in accordance with claim 14, wherein said weaving pattern formed by weaving paper-side warp and weft threads is continued by weaving said binding threads with the paper-side warp or weft threads.

16. The paper machine clothing in accordance with claim 14, wherein said weaving pattern formed by weaving the paper-side warp and weft threads is formed on its own or in combination by at least one of: at least one basic textile weave, at least one derivative of a basic textile weave, and at least one extension of a basic textile weave.

17. The paper machine clothing in accordance with claim 14, wherein said weaving pattern formed by weaving the machine-side warp and weft threads is formed on its own or in combination by at least one of: at least one basic textile weave, at least one derivative of a basic textile weave, and at least one extension of a basic textile weave.

18. The paper machine clothing in accordance with claim 14, wherein said weaving pattern formed by weaving the binding threads with the paper-side warp or weft threads is formed on its own or in combination by: at least one basic textile weave and/or at least one derivative of a basic textile weave and/or at least one extension of a basic textile weave.

19. The paper machine clothing in accordance with claim 14, wherein said weaving pattern formed by weaving the binding threads with the machine-side warp or weft threads is formed on its own or in combination by at least one of: at least one basic textile weave, at least one derivative of a basic textile weave, and at least one extension of a basic textile weave.

20. The paper machine clothing in accordance with claim 1, wherein said forming fabric has a thickness of less than 0.7 mm.

21. The paper machine clothing in accordance with claim 1, wherein said forming fabric has a width of greater than 8 meters.

22. The paper machine clothing in accordance with claim 1, wherein said forming fabric is structured to be driven with a machine speed greater than 1500 m/min.

23. The paper machine clothing in accordance with claim 1, wherein said forming fabric is used for the production of graphic paper.

24. The paper machine clothing in accordance with claim 1, wherein the weaving pattern is formed by a combination of:

the at least one extension of a basic textile weave, and
at least one basic textile weave.

25. The paper machine clothing in accordance with claim 1, wherein the weaving pattern is formed by a combination of:

the at least one extension of a basic textile weave, and
at least one derivative of a basic textile weave.

26. The paper machine clothing in accordance with claim 1, wherein the weaving pattern is formed by a combination of:

the at least one extension of a basic textile weave,
at least one basic textile weave, and
at least one derivative of a basic textile weave.

27. The paper machine clothing in accordance with claim 1, wherein the at least one extension of a basic textile weave comprises an addition of one of individual warp raising points or a plurality of warp raising points to a weaving points of a weft weave.

28. The paper machine clothing in accordance with claim 25, wherein:

the at least one extension of a basic textile weave comprises an addition of one of individual warp raising points and a plurality of warp raising points to a weaving points of a weft weave, and the at least one derivative of a basic textile weave comprises a basic weave in which there is one of: a changed offset, duplication of individual threads, duplication of groups of threads, mirroring, and displacement of individual binding passages.

29. The paper machine clothing in accordance with claim 1, wherein the repeat units comprise a 30-shaft warp repeat formed by a combination of a 10-shaft satin weave, a 10 shaft weft-side broad satin wale twill weave, and a 10-shaft cross twill weave.

* * * * *